US008717242B2

(12) United States Patent
Lavedas et al.

(10) Patent No.: US 8,717,242 B2
(45) Date of Patent: May 6, 2014

(54) METHOD FOR CONTROLLING FAR FIELD RADIATION FROM AN ANTENNA

(75) Inventors: Thomas G. Lavedas, Clifton, VA (US); Craig E. Matter, Reston, VA (US); Kim Degnan, legal representative, Reston, VA (US); Milan Chukel, Dale City, VA (US)

(73) Assignee: Raytheon Company, Waltham, MA (US)

( * ) Notice: Subject to any disclaimer, the term of this patent is extended or adjusted under 35 U.S.C. 154(b) by 365 days.

(21) Appl. No.: 13/027,434

(22) Filed: Feb. 15, 2011

(65) Prior Publication Data

US 2012/0206309 A1 Aug. 16, 2012

(51) Int. Cl.
*H01Q 11/12* (2006.01)
*H01Q 7/00* (2006.01)
*H01Q 9/14* (2006.01)

(52) U.S. Cl.
USPC ..... 343/742; 343/748

(58) Field of Classification Search
USPC ..... 343/856, 868, 823, 723, 861, 742
See application file for complete search history.

(56) References Cited

U.S. PATENT DOCUMENTS

| | | | | | |
|---|---|---|---|---|---|
| 1,911,234 | A | * | 5/1933 | Meyer | 343/823 |
| 3,284,801 | A | * | 11/1966 | Bryant | 343/743 |
| 3,453,630 | A | * | 7/1969 | Thompson | 343/757 |
| 3,774,221 | A | | 11/1973 | Francis | |
| 3,823,403 | A | | 7/1974 | Walter et al. | |
| 3,950,756 | A | * | 4/1976 | Tisler | 343/766 |
| 4,160,978 | A | | 7/1979 | DuHamel | |
| 4,375,289 | A | | 3/1983 | Schmall et al. | |
| 4,680,591 | A | | 7/1987 | Axford et al. | |
| 4,791,285 | A | | 12/1988 | Ohki | |
| 4,920,352 | A | | 4/1990 | Martensson et al. | |
| 4,977,614 | A | | 12/1990 | Kurcbart | |
| 5,061,941 | A | * | 10/1991 | Lizzi et al. | 343/742 |
| 5,101,214 | A | * | 3/1992 | Ohtsuka et al. | 343/803 |
| 5,128,686 | A | | 7/1992 | Tan et al. | |
| 5,221,902 | A | | 6/1993 | Jones et al. | |

(Continued)

FOREIGN PATENT DOCUMENTS

| | | |
|---|---|---|
| JP | H11-313017 | 11/1999 |
| WO | WO 2006/107862 A2 | 10/2006 |
| WO | WO 2010/002821 A1 | 1/2010 |

OTHER PUBLICATIONS

U.S. Appl. No. 13/027,560, Thomas G. Lavedas, filed Feb. 15, 2011, 20 pages.

(Continued)

*Primary Examiner* — Dameon Levi
*Assistant Examiner* — Ricardo Magallanes
(74) *Attorney, Agent, or Firm* — Daly, Crowley, Mofford & Durkee, LLP

(57) ABSTRACT

An antenna includes a first loop defining a first enclosed area and having a first phase center point, a second loop coupled to the first loop and disposed substantially parallel to the first loop, the second loop defining a second enclosed area, and a third loop coupled to the first loop and the second loop and substantially parallel to the first loop, the third loop defining a third enclosed area with a plurality of adjuster elements coupled to at least one of the first loop, the second loop, or the third loop to provide an adjustable loop and configured to expand or contract the enclosed area of the adjustable loop.

21 Claims, 11 Drawing Sheets

(56) References Cited

U.S. PATENT DOCUMENTS

| | | | | |
|---|---|---|---|---|
| 5,237,165 | A | 8/1993 | Tingley, III | |
| 5,459,451 | A | 10/1995 | Crossfield et al. | |
| 5,513,383 | A | 4/1996 | Tsao | |
| 5,602,556 | A | 2/1997 | Bowers | |
| 5,903,242 | A | 5/1999 | Tsuru et al. | |
| 5,945,958 | A | 8/1999 | Staufer et al. | |
| 6,031,508 | A | 2/2000 | Ishizuka et al. | |
| 6,208,874 | B1 | 3/2001 | Rudisill et al. | |
| 6,597,318 | B1 | 7/2003 | Parsche et al. | |
| 6,814,284 | B2 | 11/2004 | Ehlers et al. | |
| 6,825,754 | B1 | 11/2004 | Rolin | |
| 6,970,141 | B2 * | 11/2005 | Copeland et al. | 343/866 |
| 7,215,293 | B2 | 5/2007 | Chen et al. | |
| 7,714,791 | B2 | 5/2010 | Lavedas | |
| 2003/0197653 | A1 | 10/2003 | Barber et al. | |
| 2004/0006424 | A1 | 1/2004 | Joyce et al. | |
| 2007/0185546 | A1 | 8/2007 | Tseng et al. | |
| 2009/0034595 | A1 * | 2/2009 | Kato et al. | 375/222 |
| 2010/0001914 | A1 * | 1/2010 | Lavedas | 343/742 |
| 2011/0148733 | A1 * | 6/2011 | Fahs et al. | 343/859 |

OTHER PUBLICATIONS

Kurz et al.; "Wireless Power Transfer via Strongly Coupled Magnetic Resonances;" www.sciencemag.org; vol. 317, dated Jul. 6, 2007; pp. 83-86.

PCT International Preliminary Report on Patentability of the ISA dated Jan. 5, 2011 for PCT Patent App. No. PCT/US2009/049136; 8 pages.

PCT Notification of Transmittal of the International Search Report and the Written Opinion of the ISA dated Aug. 4, 2009 for PCT Patent App. No. PCT/US2009/049136; 1 page.

PCT International Search Report of the ISA dated Aug. 4, 2009 for PCT Patent App. No. PCT/US2009/049136; 4 pages.

PCT International Written Opinion of the ISA dated Aug. 4, 2009 for PCT Patent App. No. PCT/US2009/049136; 7 pages.

* cited by examiner

METHOD FOR CONTROLLING FAR FIELD RADIATION FROM AN ANTENNA

FIELD OF THE INVENTION

This invention generally relates to controlling far field radiation from an antenna and more particularly, to controlling far field radiation from an antenna to cancel the far field radiation.

BACKGROUND

Radio frequency identification (RFID) systems operating in the high-frequency range, typically at 13.56 Megahertz (MHz), are radiation limited by governmental regulations, such as the Federal Communications Commission (FCC) rules governing the industrial, scientific, and medical (ISM) operating bands commonly used for these unlicensed systems, in particular 47CFR15.225. These RFID systems are commonly known as vicinity readers because they are capable of reading credit card sized RFID tags to a distance of 60 centimeters (about two feet).

As is known in the art, antenna systems have near-field and far-field radiation regions. The near field is a region near an antenna where the angular field distribution depends upon the distance from the antenna. The near field is generally within a small number of wavelengths from the antenna and is characterized by a high concentration of energy and energy storage in non-radiating fields. In contrast, the far field is the region outside the near field, where the angular distributions of the fields are essentially independent of the distance from the antenna. Generally, the far-field region is established at a distance of greater than $D^2/\lambda$ from the antenna, where D is an overall dimension of the antenna that is large compared to wavelength $\lambda$. The far-field region is where radiation from the antenna is said to occur.

RFID systems use near fields for communications between the RFID tag and the RFID interrogator. Also, the energy stored in the near fields provides the power to drive a microchip imbedded in a passive RFID transponder tag. Many conventional RFID systems use loop-type radiators for interrogator antennas, for example, an antenna consisting of a figure-eight shaped conductor.

Conventional RFID systems are being increasingly used to enhance supply chain activities, security, and a myriad of other applications and industries. However, conventional RFID systems often have limited operating ranges, which limits their usefulness. Attempts to increase RFID system range, however, often result in the need for increasing input power, which violates FCC radiation limitations, generally because of proportional increases in far-field radiation.

It would, therefore, be useful to provide an RFID system that can increase near field radiation while simultaneously reducing far-field radiation. Such an RFID system would have an increased operating range while abiding by applicable governmental RF radiation regulations.

SUMMARY

In general overview, the inventive systems, concepts, and techniques described herein are directed to an antenna having reduced, minimized, and/or substantially cancelled far-field radiation while near-field radiation may be substantially maintained. In one particular embodiment, one or more adjuster elements are coupled to a multi-looped antenna and configured to adjust a size of an enclosed area of at least one of the antenna loops. The antenna loops are substantially parallel to each other and have phase center points coincident with a line normal to planes defined by the antenna loop.

In some embodiments, a first adjuster element and a second adjuster element are coupled to opposing sides of an antenna loop and are configured to adjust (i.e. expand and/or contract) respective lengths of the sides of the antenna loop to minimize differences in the sizes of the enclosed areas of the antenna loops. The opposing adjuster elements may be coupled to a support frame to stabilize the antenna and to facilitate expansion or contraction of the enclosed area of the antenna loop symmetrically about the phase center point of the antenna loop.

In the same or different embodiment, one or more transformers are coupled to the antenna and configured to control relative current flowing through a first antenna loop and a second antenna loop. When combined with the one or more adjuster elements, far-field radiation from the antenna can be reduced, minimized and/or substantially canceled. In one particular embodiment in which an outer loop surrounds a smaller inner loop (and in which the outer and inner loops are substantially parallel, have coincident phase center points, and a current flows in equal and opposite polarity in the outer and inner loops), a ratio of the number of turns of the primary and secondary coil of a transformer may be controlled to increase current supplied to the inner loop such that the inner loop can generate far-field radiation of substantially equal (and opposite) strength to far-field radiation generated by the outer loop. The far-field radiation generated by each of the loops is out-of-phase and coincident and so tends to cancel out.

Advantageously, the antenna may be adjusted to reduce, minimize and/or substantially cancel far-field radiation from the antenna while near-field radiation from the antenna tends to be substantially maintained.

In some exemplary embodiments described herein, the inventive systems, concepts, and techniques provide an adjustable antenna with substantial cancellation of far-field radiation, while near-field radiation may be substantially maintained. Far-field radiation cancellation is dependent on antenna loops having substantially equal enclosed areas and coincident phase center points. For example, the amount of far-field radiation cancellation for an antenna corresponds to a difference in size of the total enclosed area of inner loops and size of enclosed area of an outer loop. Generally, the smaller the difference in these sizes the greater the antenna far-field cancellation. Adjuster elements can be used to fine-tune loop geometries (by minimizing and/or eliminating the difference in sizes) to achieve the highest possible cancellation of far-field antenna radiation.

Antennas according to the inventive systems, concepts, and techniques described herein may be configured to interoperate with various types of RFID tags. For example, an antenna may supply radiated power to a passive RFID tag. In another configuration, the RFID tag may be semi-passive in that the RFID tag is battery-powered instead of inductively powered, while the RFID tag modulates the incident RF energy to communicate with the interrogating device. For example, the RFID chip may be battery powered while the RFID transmitter may modulate the incident RF field. In still another configuration, the RFID tag is an active RFID tag driven by battery power and responding with an RF field created by the RFID tag.

In some environments, an antenna is provided having reduced and/or substantially eliminated far-field radiation while maintaining signal reception in the near-region of the antenna. In one particular application, an RFID transponder can incorporate the antenna to extend the distance at which RFID tags can be reliably detected and identified. For example, the antenna can extend the operating range of systems using credit card sized RFID tags.

Antennas according to the inventive systems, concepts, and techniques described herein may be configured to energize a device (i.e., a portable device such as a smart phone) through inductive coupling. The device can include, but is not limited to, a cell phone, a laptop, a hand-held game unit or other electronic device. The term energize includes providing instantaneous energy to the device to enable use of the device, for example, providing instantaneous energy to a smart phone during a call or to read email on the smart phone. Energize also includes providing energy over time to recharge a device's energy storage cell, for example, recharging a cell phone battery. A battery includes, but is not limited to, rechargeable electrochemical cells, also known in the art as secondary cells, for example, NiCd, NiMH, and rechargeable alkaline batteries. Other energy storage cells include those used to power electric vehicles.

In some environments, antennas according to the inventive systems, concepts, and techniques described herein are configured to be mountable in a low-profile environment, such as a ceiling or wall space, furniture, and other devices. A device may be positioned to maximize an amount of energy received from an antenna via inductive coupling. For example, a device may be positioned on a table top directly beneath an antenna mounted behind a ceiling tile.

In still other environments, antennas according to the inventive systems, concepts, and techniques described herein are configured to detect explosives, for example, when incorporated into a mine detector to detect mines or a nuclear quadruple resonance system to detect material composition via radio frequency spectral responses.

The inventive systems, concepts, and techniques should not be construed as limited the above-described environments and applications and may be used when it is desired, needed, or necessary to enhance reception in a near-field region about an antenna and/or to control radiation in a far-field region about the antenna.

In one aspect, an antenna includes a first loop defining a first enclosed area and having a first phase center point defined by the geometric center point of the first enclosed area, a second loop coupled to the first loop and disposed substantially parallel to the first loop, the second loop defining a second enclosed area and a second phase center point defined by the geometric center point of the second enclosed area, and a third loop coupled to the first loop and the second loop and substantially parallel to the first loop, the third loop defining a third enclosed area and a third phase center point defined by the geometric center point of the third enclosed area. The antenna includes a plurality of adjuster elements coupled to at least one of the first loop, the second loop, or the third loop, herein known as the adjustable loop, and configured to expand or contract the enclosed area of the adjustable loop. A line normal to the plane of the first loop passes through the first phase center point of the first loop, the second phase center point of the second loop, and the third phase center point of the third loop, and a current supplied to the antenna flows in a first polarity in the third loop and flows in a second polarity in the first loop and the second loop, the first and second polarities being opposite to each other.

In another aspect, an antenna includes a first loop defining a first enclosed area and having a first phase center point defined by the geometric center point of the first enclosed area, a second loop coupled to the first loop and substantially parallel to the first loop, the second loop defining a second enclosed area and having a second phase center point defined by the geometric center point of the second enclosed area, and a first adjuster element coupled to an adjustable loop, which is the same as one of the first loop or the second loop, and operable to expand or contract the enclosed area of the adjustable loop. A line normal to the plane of the first loop passes through the first and second phase center points, and a current supplied to the antenna is of opposite polarity in the respective first and second loops.

In another aspect, a method for controlling far field radiation from an antenna having a first loop, a second loop, and a third loop includes providing current of a first polarity to first and second loops and of a second polarity opposite to the first polarity to the third loop and adjusting the area of an adjustable loop which is the same as one of the first loop, the second loop, or the third loop to reduce a difference in a total size of a first enclosed area defined by the first loop and a second enclosed defined by the second loop and a size of a third enclosed area defined by the third loop such that the far field radiation from the first loop and the second loop is of opposite phase and equal strength to the far field radiation from the third loop to cancel far field radiation from the antenna.

In a further aspect, a method for controlling far field radiation from an antenna having a first loop defining a first enclosed area and a second loop defining a second enclosed area includes providing current of reverse polarity to both loops and adjusting the length of an adjustable loop, which is the same as one of the first or second loops, to reduce the difference in size of the first enclosed area and the second enclosed area such that the far field radiation from the first loop and the second loop is of opposite phase and relatively equal strength to cancel far field radiation from the antenna.

BRIEF DESCRIPTION OF THE DRAWINGS

The foregoing features of the antenna, techniques, and concepts described herein, may be more fully understood from the following description of the drawings in which.

DETAILED DESCRIPTION

Figure 1:
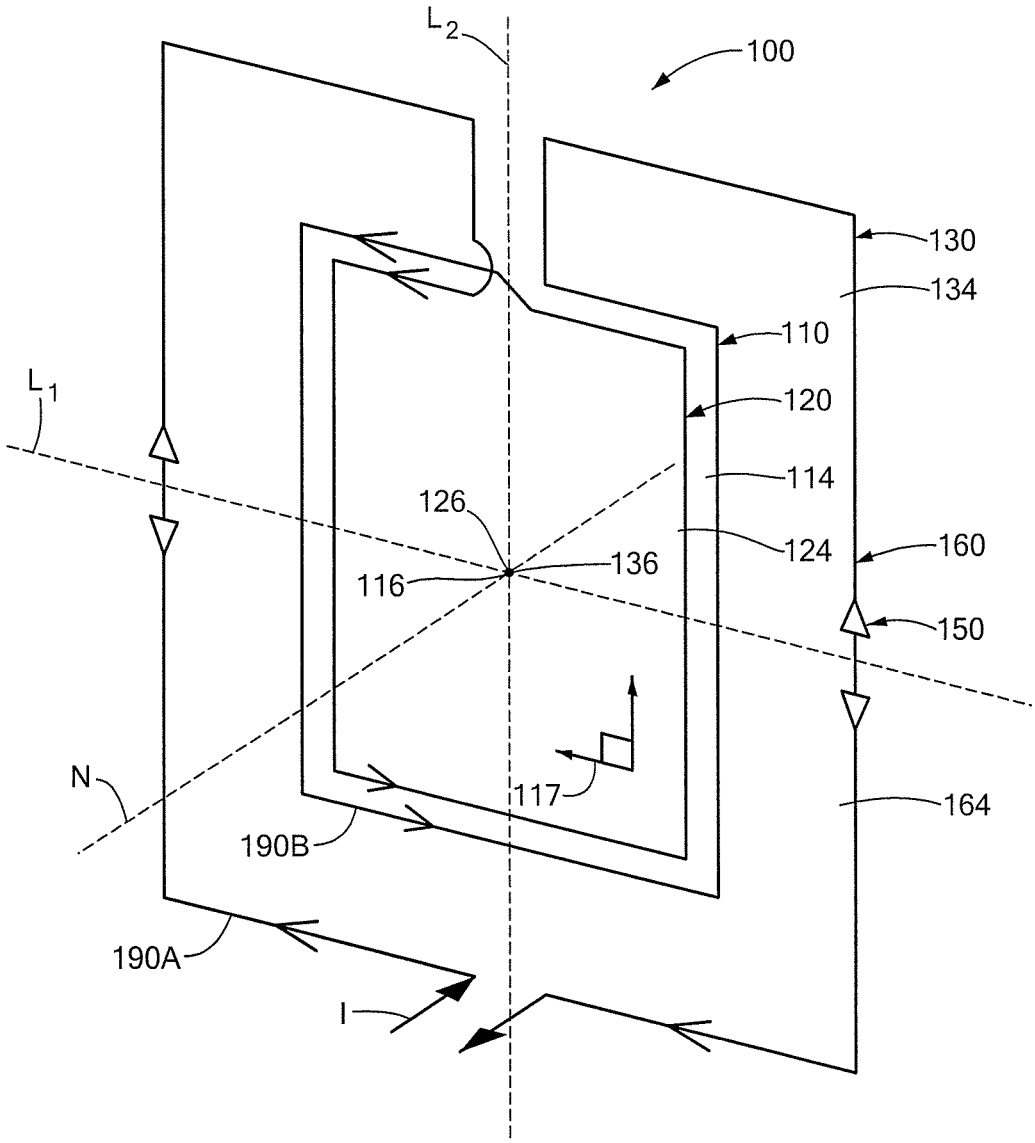
FIG. 1 is a pictorial view of an embodiment of an antenna according to the systems, concepts, and techniques described herein.

Referring to FIG. 1, in one embodiment antenna 100 includes first loop 110 defining first enclosed area 114 and having first phase center point 116 defined by the geometric center point of first enclosed area 114. Antenna 100 also includes second loop 120 coupled to first loop 110, disposed substantially parallel to first loop 110, and defining second enclosed area 124 substantially equal in size to first enclosed area 114 and having second phase center point 126 defined by the geometric center point of second enclosed area 124. Third loop 130 is coupled to first loop 110 and second loop 120, disposed substantially parallel to first loop 110 and defining third enclosed area 134 and having third phase center point 136 defined by the geometric center point of third enclosed area 134.

First loop 110 defines plane 117. Line N normal to plane 117 passes through first phase center point 116 of first loop 110, second phase center point 126 of second loop 120, and third phase center point 136 of third loop 130. As can be seen in FIG. 1, first, second, and third phase center points are coincident at dashed line $L_1$ and dashed line $L_2$ which cross at geometric center points of enclosed areas 114, 124, and 134 of respective first, second, and third loops 110, 120, 130. Current (designed by I) provided to antenna 100 flows in first polarity 190A (for example, in a clockwise direction with respect to the plane of the paper) in third loop 130 and flows in second polarity 190B (for example, in a counterclockwise direction with respect to the plane of the paper) in first loop 110 and second loop 120, first and second polarities 190A, 190B opposite to each other.

Antenna 100 further includes a plurality of adjuster elements (generally represented by reference numeral 150) coupled to adjustable loop (example of which is designated by reference numeral 160) which is the same as one of first loop 110, second loop 120, or third loop 130 and operable to expand or contract enclosed area (example of which is designated by reference numeral 164) of adjustable loop 160. In some embodiments, expanding or contracting enclosed area 164 may correspond to lengthening or shortening a length of adjustable loop 160 as will be described herein below.

In a further embodiment and as illustrated in FIG. 1, adjustable loop 160 is third loop 130 and therefore adjuster elements 150 are operable to expand or contract third enclosed area 134 of third loop 130.

Figure 2A:
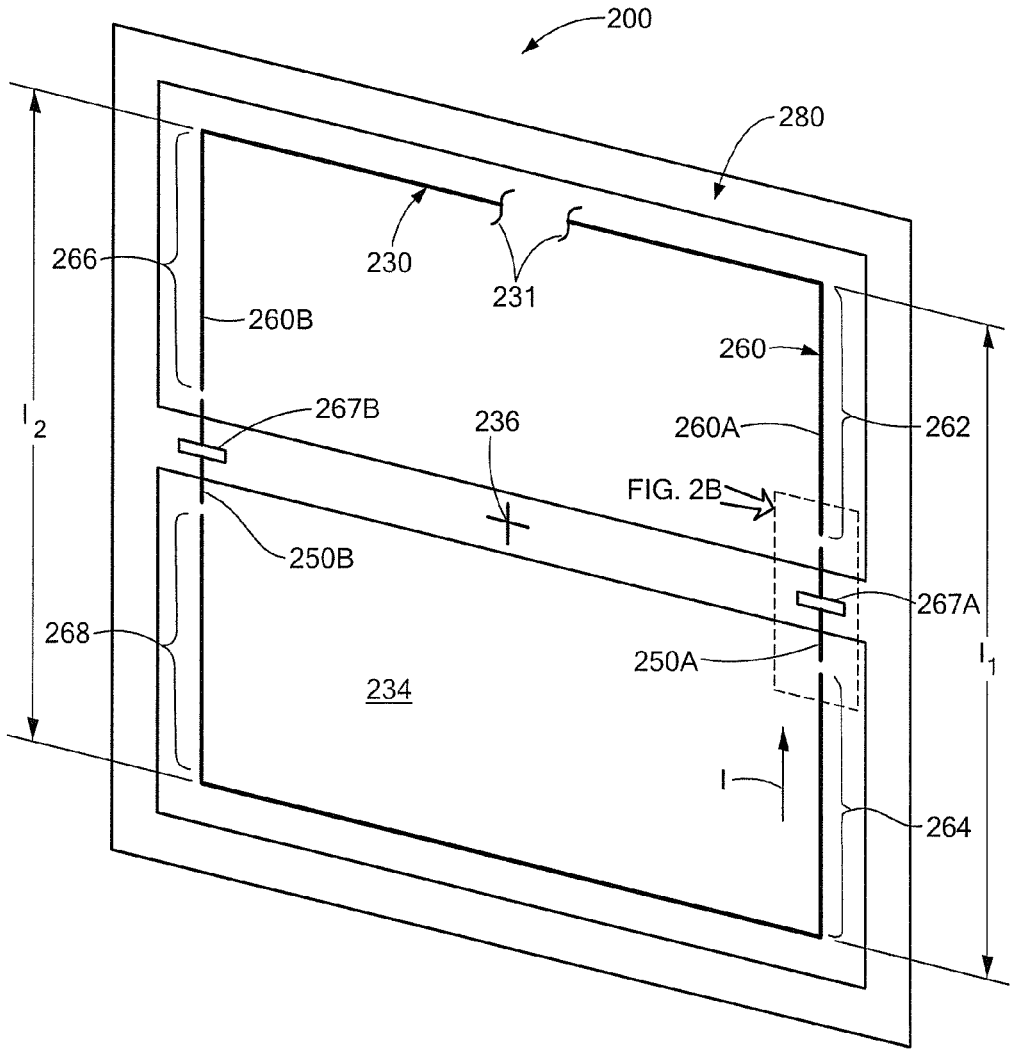
FIG. 2A is a pictorial view of an embodiment of an adjustable loop of the antenna of FIG. 1.

Referring now to FIG. 2A, in a further embodiment antenna 200 includes adjustable loop 230, first adjuster element 250A, and second adjuster element 250B. Antenna 200 also includes further loops (i.e., loops 110, 120 of antenna 100 described in conjunction with FIG. 1) which have been omitted for clarity in the illustration. Endings 231 are included in FIG. 2A to denote where further loops may be coupled to adjustable loop 230.

In one particular configuration shown in FIG. 2A, adjustable loop 230 is a rectilinear and includes four sides (generally designated by reference numeral 260). However, adjustable loop 230 should not be construed as limited to a rectilinear configuration (i.e., a configuration in which sides join at right angles to each other) and can include most any number of sides including, but not limited to, three sides, five, six, ten, twenty, etc.

First adjuster element 250A is operable to expand or contract length $l_1$ of first side 260A of adjustable loop 230 and second adjuster element 250B is operable to expand or contract length $l_2$ of second side 260B of adjustable loop 230. In a further embodiment, second side 250B laterally opposes first side 250A of adjustable loop 230.

Figure 2B:
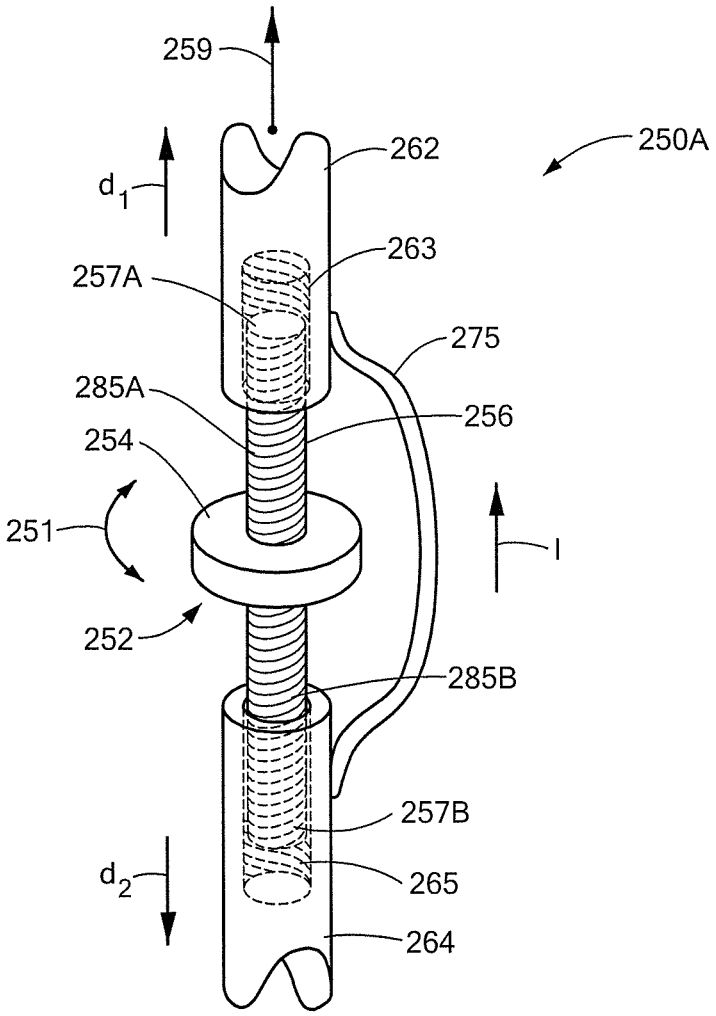
FIG. 2B is a close-up pictorial view of an embodiment of an adjuster element.

Referring now to FIG. 2B showing a close-up view of an embodiment of first adjuster element 250A and again to FIG. 2A, first adjuster element 250A can include first screw assembly 252 operable to expand or contract length $l_1$ of first side 260A of adjustable loop 230. First side 260A is defined by first portion 262 and second portion 264 of adjustable loop 230. First screw assembly 252 includes wheel 254 and shaft 256 coupled to wheel 254 along longitudinal axis 259 of shaft 256.

Shaft 256 has first end 257A rotatably coupled to first portion 262 of adjustable loop 230 and second end 257B opposing first end 257A rotatably coupled to second portion 264 of adjustable loop 230. In a further embodiment, first portion 262 defines hollow, cylindrical void 263 and second portion 264 defines hollow, cylindrical void 265. Interior walls adjacent to voids 263, 265 are threaded to rotatably receive respective threaded portions 285A, 285B proximate to ends 257A, 257B of shaft 256. Threaded portions 285A, 285B (and interior walls) have threads oriented such that rotation of wheel 254 (as designated by reference numeral 251) results in translation of first portion 262 in first direction $d_1$ and translation of second portion 264 in second direction $d_2$. As can be seen in FIG. 2B, first direction $d_1$ is opposite to second direction $d_2$ and, thusly, rotation of wheel 254 results in expansion of length $l_1$ of first side 250A (as shown in FIG. 2B) or contraction of length $l_1$ of first side 260A.

In another embodiment, second adjuster element 250B includes a second screw assembly operable to expand or contract length $l_2$ of second side 260B of adjustable loop 230. Second side 260B is defined by third portion 266 and fourth portion 268 of adjustable loop 230.

In another embodiment, first adjuster element 250A and second adjuster element 250B are electrically conductive such that current I can flow in adjustable loop 230 along first side 260A (via first adjuster element 250A) and second side 260B (via second adjuster element 250B). In the same or different embodiment, antenna 200 further includes flexible conductive member 275 to electrically couple one of first portion 262 and second portion 264 of adjustable loop 230 or third portion 266 and fourth portion 268 of adjustable loop 230. Here, flexible conductive member 275 expands or contracts in correspondence to expansion or contraction of a coupled side. For example, as shown in FIG. 2B, flexible conductive member 275 couples first portion 262 and second portion 264 of first side 260A and can bend in correspondence to expansion or contraction of side 260A as it supplies current I. In still a further embodiment, flexible conductive member 275 includes a conductive strip, rod, and or spring.

Referring again to FIG. 2A, in a further embodiment support frame 280 is coupled to first adjuster element 250A and/or second adjuster element 250B. In still a further embodiment, support frame 280 is coupled at midpoint 267A of first side 260A of adjustable loop and at midpoint 267B of second side 260B of adjustable loop 230. In this way, support frame 280 can stabilize antenna 200 so that first adjuster element 260A and second adjuster element 260B can expand or contract enclosed area 234 of adjustable loop 230 symmetrically about phase center point 236 of adjustable loop 230.

Figure 3A:
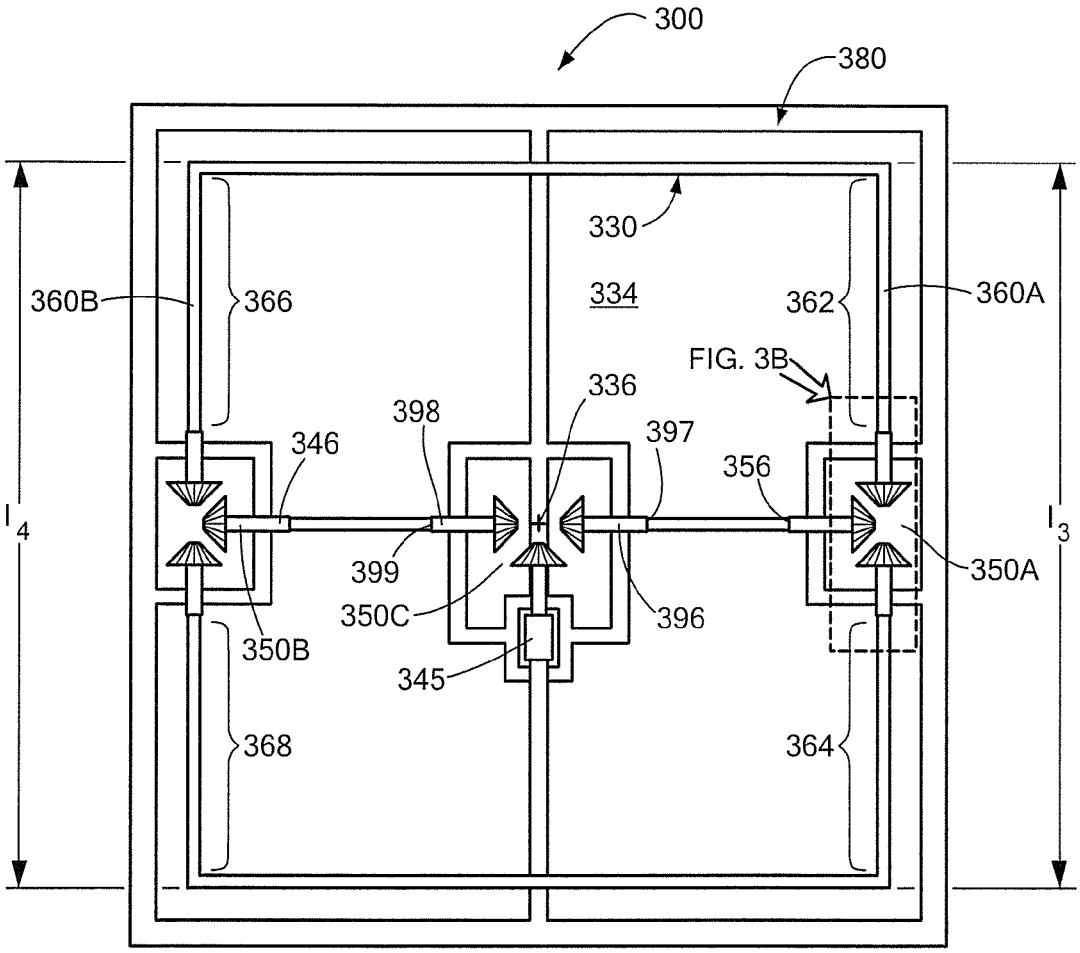
FIG. 3A is a pictorial view of another embodiment of an adjustable loop of the antenna of FIG. 1.

Referring now to FIG. 3A, in another embodiment antenna 300 includes adjustable loop 330, first adjuster element 350A and second adjuster element 350B. First adjuster element 350A is operable to expand or contract length $l_3$ of first side 360A of adjustable loop 330 defined by first portion 362 and second portion 364 of adjustable loop 330. Second adjuster element 350B is configured to expand or contract length $l_4$ of second side 360B of adjustable loop 330 defined by third portion 366 and fourth portion 368 of adjustable loop 330. Antenna 300 also includes further loops (i.e., loops 110, 120 of antenna 100 described in conjunction with FIG. 1) which have been omitted for clarity in the illustration.

Figure 3B:
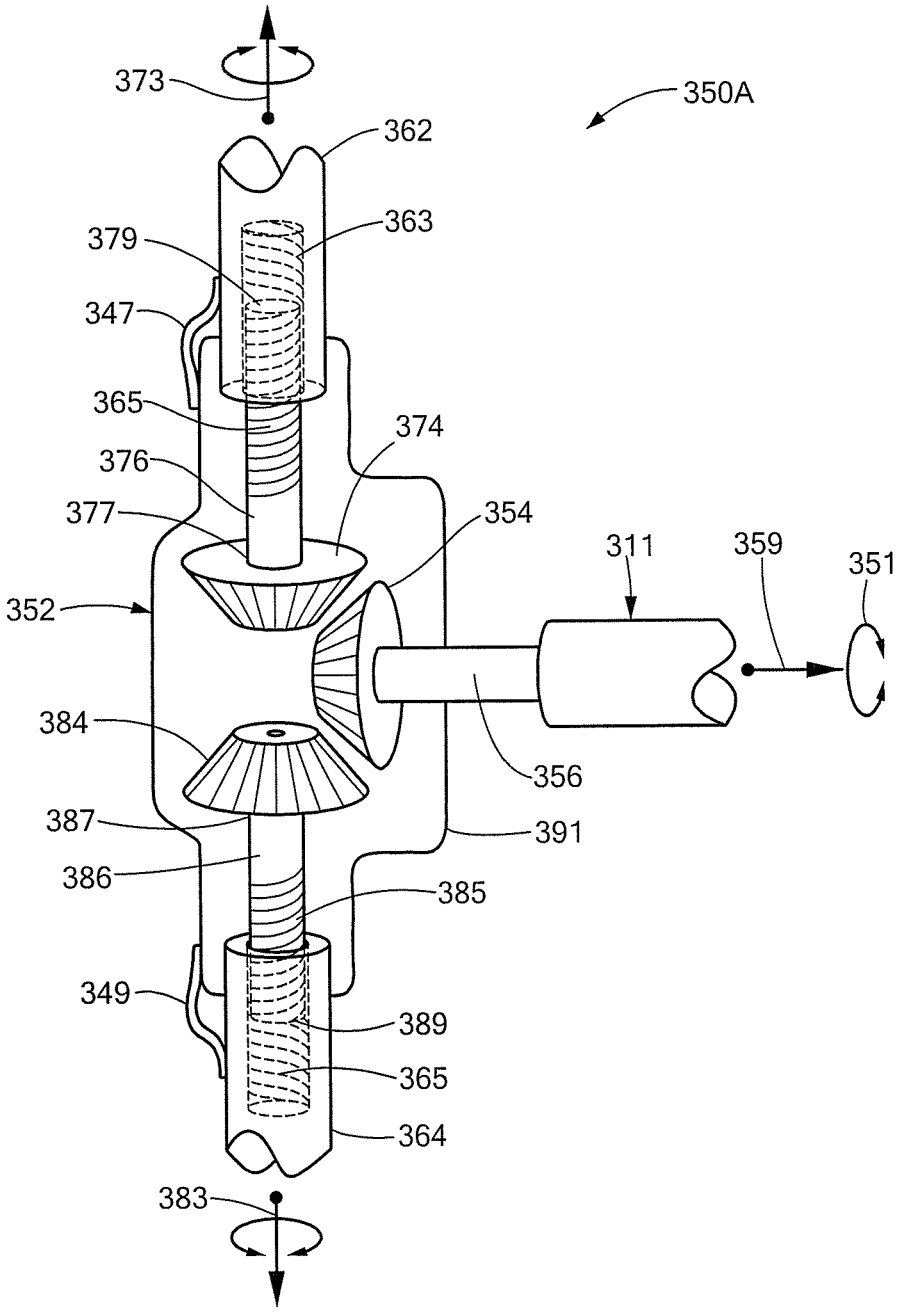
FIG. 3B is a close-up, partially internal view of another embodiment of an adjuster element.

Referring now to FIG. 3B showing a close-up, inside view of an embodiment of first adjuster element 350A and again to FIG. 3A, first adjuster element 350A includes a first bevel gear assembly 352 including dual drive bevel gear 354 and dual drive shaft 356 coupled to dual drive bevel gear 354 and operable to rotate dual drive bevel gear 354 about longitudinal axis 359 of dual drive shaft 356. First bevel gear assembly 350A further includes first drive bevel gear 374 rotatably coupled to dual drive bevel gear 354 and to first drive shaft 376, which is coupled at one end 377 to first drive bevel gear 374 and rotatably coupled at another end 379 to first portion 362 of adjustable loop 330. Second drive bevel gear 384 opposes first drive bevel gear 374 and is rotatably coupled to dual drive bevel gear 354 and to second drive shaft 386, which is coupled at one end 387 to second drive bevel gear 384 and rotatably coupled at another end 389 to second portion 364 of adjustable loop 330. It should be noted that dual drive bevel gear 354, first drive bevel gear 374, and second drive bevel gear 384 have respective gear teeth which engage with each other, however, dual drive bevel gear 354, first drive bevel gear 374, and second drive bevel gear 384 are drawn in partially exploded view in FIG. 3B for clarity in the illustration.

In a further embodiment, first portion 362 defines hollow, cylindrical void 363 and second portion 364 defines hollow, cylindrical void 365. Interior walls adjacent to these voids 363, 364 are threaded to rotatably receive respective threaded portions 365, 385 of respective first and second drive shafts 376, 386. Threaded portions 365, 385 (and interior walls) have threads oriented such that rotation of dual drive bevel gear 354 (as designated by reference numeral 351) rotates first drive bevel gear 374 and first drive shaft 376 about longitudinal axis 373 and rotates second drive bevel gear 384 and second drive shaft 386 about longitudinal axis 383. Furthermore, first drive bevel gear and first drive shaft rotate in a direction opposite to second drive bevel gear and second drive shaft such that rotation 351 of dual drive bevel gear 356 results in simultaneous translation of first portion 362 and second portion 364 to expand length $l_3$ of first side 360A or contract length $l_3$ of first side 360A.

In a further embodiment, first bevel gear assembly 352 includes adjustment drive 311 coupled to dual drive shaft 356. Adjustment drive 311 may be human-operated (for example, a human operator may grasp adjustment drive 311 between her thumb and forefinger) and/or machine-operated using, for example, a motor. Rotation of adjustment drive 311 about axis 359 correspondingly operates first bevel gear assembly to expand and or contract first side 360A of adjustable loop 300.

In a further embodiment, first bevel gear assembly 350A is enclosed in housing 391 fixed to frame 380 such that the first bevel gear assembly 350A remains in a fixed position relative to phase center point 336 of adjustable loop 330.

In another embodiment, first conductor 347 electrically couples first portion 362 and first bevel gear assembly housing 391. Here, first bevel assembly gear housing 391 includes a conductive material and first conductor 347 maintains contact with housing 391 as first portion 362 expands or contracts. Similarly, second conductor 349 electrically couples second portion 364 and first bevel gear assembly housing 391 as second portion 364 expands or contracts.

In another embodiment, second adjuster element 350B includes a second gear assembly (as may be the same or similar to first gear assembly 350A) operable to expand or contract length $l_4$ of second side 360B of adjustable loop 330. Second side 360B is defined by third portion 366 and fourth portion 368 of adjustable loop 330.

In a further embodiment, antenna 300 includes third bevel gear assembly 350C (as may be the same or similar to first bevel gear assembly 352) operable to simultaneously expand or contract length $l_3$ of first side 360A of adjustable loop 330 and length $l_4$ of second side 360B of adjustable loop 330. First drive shaft 396 of third bevel gear assembly 350C is rotatably coupled at one end 397 to dual drive shaft 356 of first bevel gear assembly 350A and second drive shaft 398 of third bevel gear assembly 350C is rotatably coupled at one end 399 to dual drive shaft 346 of second bevel gear assembly 350B. In still a further embodiment, rotatable drum 345 is coupled to third bevel gear assembly 350C to simultaneously drive first adjuster element 350A and second adjuster element 350B. For example, a user may operate adjustment drive 345 to simultaneously drive first adjuster element 350A and second adjuster element 350B to control expansion or contraction of respective first side 360A and second side 360B of adjustable loop 330 about phase center point 336 of antenna 300. Such operations permit a user to minimize the difference in and/or substantially equalize the size of enclosed area 334 of adjustable loop 330 and the size of enclosed areas of other loops (not shown in FIG. 3A and which may include first loop 110 and second loop 120 of antenna 100). Advantageously, minimizing and/or substantially eliminating any differences between these enclosed areas (in other words, to adjust one or more of these enclosed areas such that they are substantially equal in size) can correspondingly minimize and/or substantially cancel far-field radiation from antenna 300 without significantly affecting near-field radiation from antenna 300.

Figure 4A:
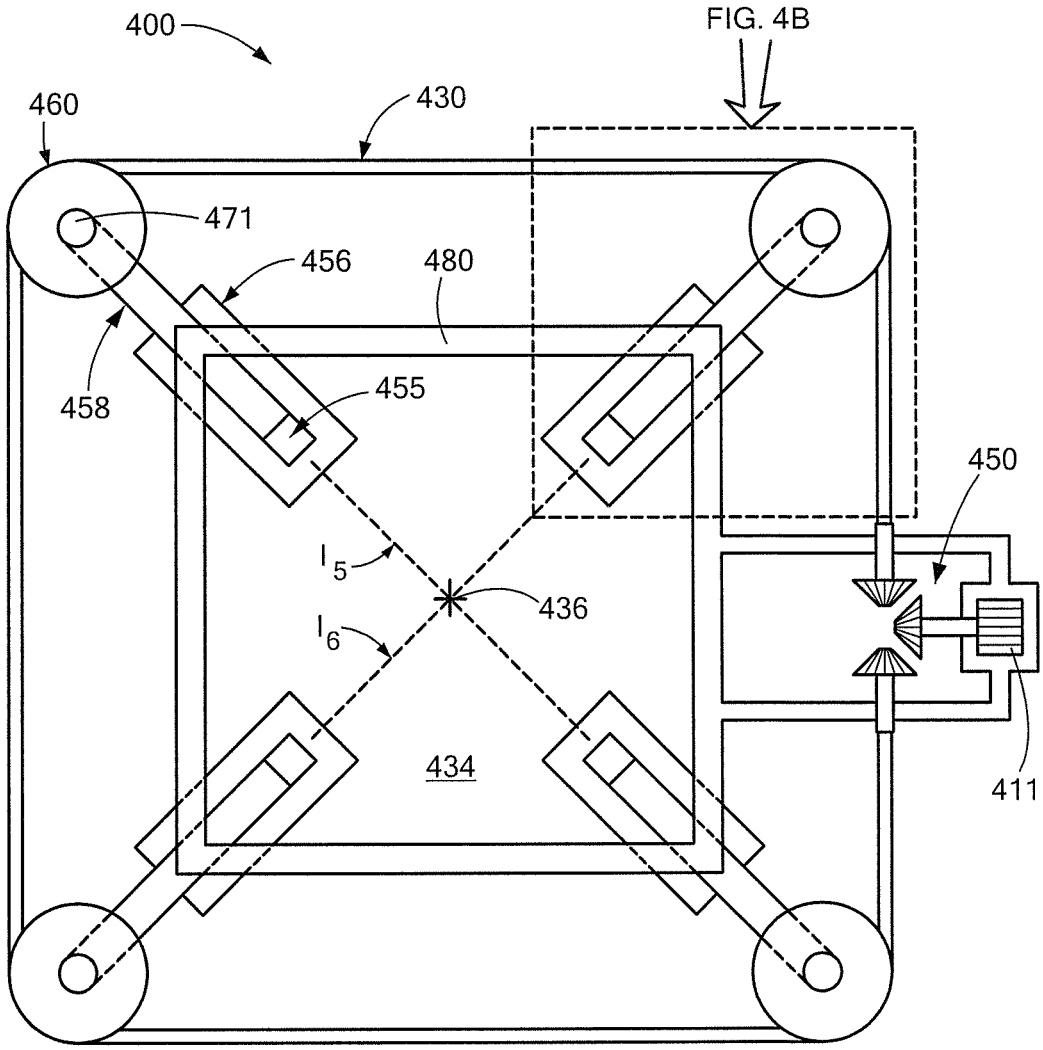
FIG. 4A is a pictorial view of yet another embodiment of an adjustable loop of the antenna of FIG. 1.

Referring now to FIG. 4A, in another embodiment antenna 400 includes plurality of pulleys (an example of which is designated by reference numeral 460), overall adjuster element 450, and support frame 480. Plurality of pulleys 460 is coupled to support frame 480 and to adjustable loop 430. Overall adjuster element 450 is adapted to rotate plurality of pulleys 460 to expand or contract adjustable loop 430 symmetrically about phase center point 436 of adjustable loop 430.

In a further embodiment, antenna 400 includes pulley directors (an example of which is designated by reference numeral 456) coupled to support frame 480 proximate to pulleys 460 and defining channels (an example of which is designated by reference numeral 455). Antenna 400 also includes pulley brackets (an example of which is designated by reference numeral 458) rotatably coupled to pulleys 460 along an axes about which pulleys 460 rotate. An example of pulley rotation axis 471 is orthogonal to the plane of the paper.

Figure 4B:
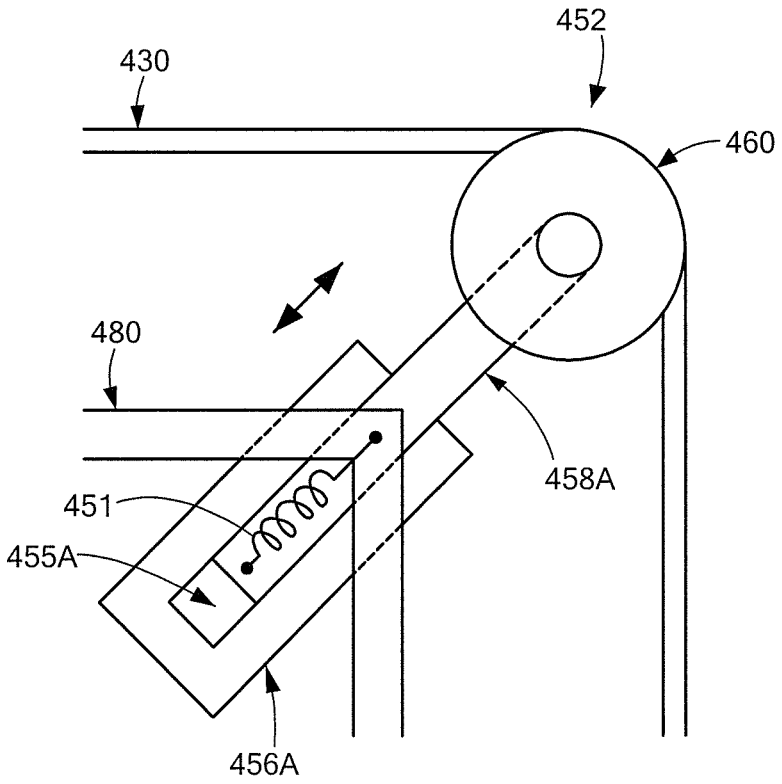
FIG. 4B is a close-up pictorial view of yet another embodiment of an adjuster element.

Referring now to FIG. 4B showing a close-up view of an embodiment of pulley adjustment assembly 452 and again to FIG. 4A, pulley spring 451 is coupled to pulley bracket 458A and to pulley director 456A and configured to direct pulley bracket 458A along channel 455 in correspondence to expansion and contraction of adjustable loop 430. More particularly, overall adjustment element 450 is coupled to adjustable loop 430 such that adjustment of overall adjustment element 450 simultaneously moves pulleys 460 inward or outward to correspondingly expand or contract adjustable loop 430. Pulley springs (for example, pulley spring 451) maintain tension between pulleys 430 and support frame 480 and help slidably guide pulleys 460 (and more particularly pulley brackets 458) inward and outward along channels 455. As can be seen in FIG. 4A, movement of pulleys 460 occurs substantially symmetrically about phase center point 436 of adjustable loop 430 along line $l_5$ and line $l_6$ to expand or contract enclosed area 434 of adjustable loop 430.

In a further embodiment, adjustable loop 430 includes a braided conductive sheath having a flexible inner core for added strength.

In a further embodiment, overall adjustment element 450 includes a bevel gear assembly, as may be the same or similar to bevel gear assembly 352 described in conjunction with FIG. 3B). In still a further embodiment, the bevel gear assembly includes an adjustment drive 411 (as may be the same or similar to adjustment drive 311 described in conjunction with FIG. 3B) which may be hand operated and/or machine operated.

It should be noted that antenna 400 also includes further loops (i.e., loops 110, 120 of antenna 100 described in conjunction with FIG. 1) which have been omitted for clarity in the illustration.

Figure 5:
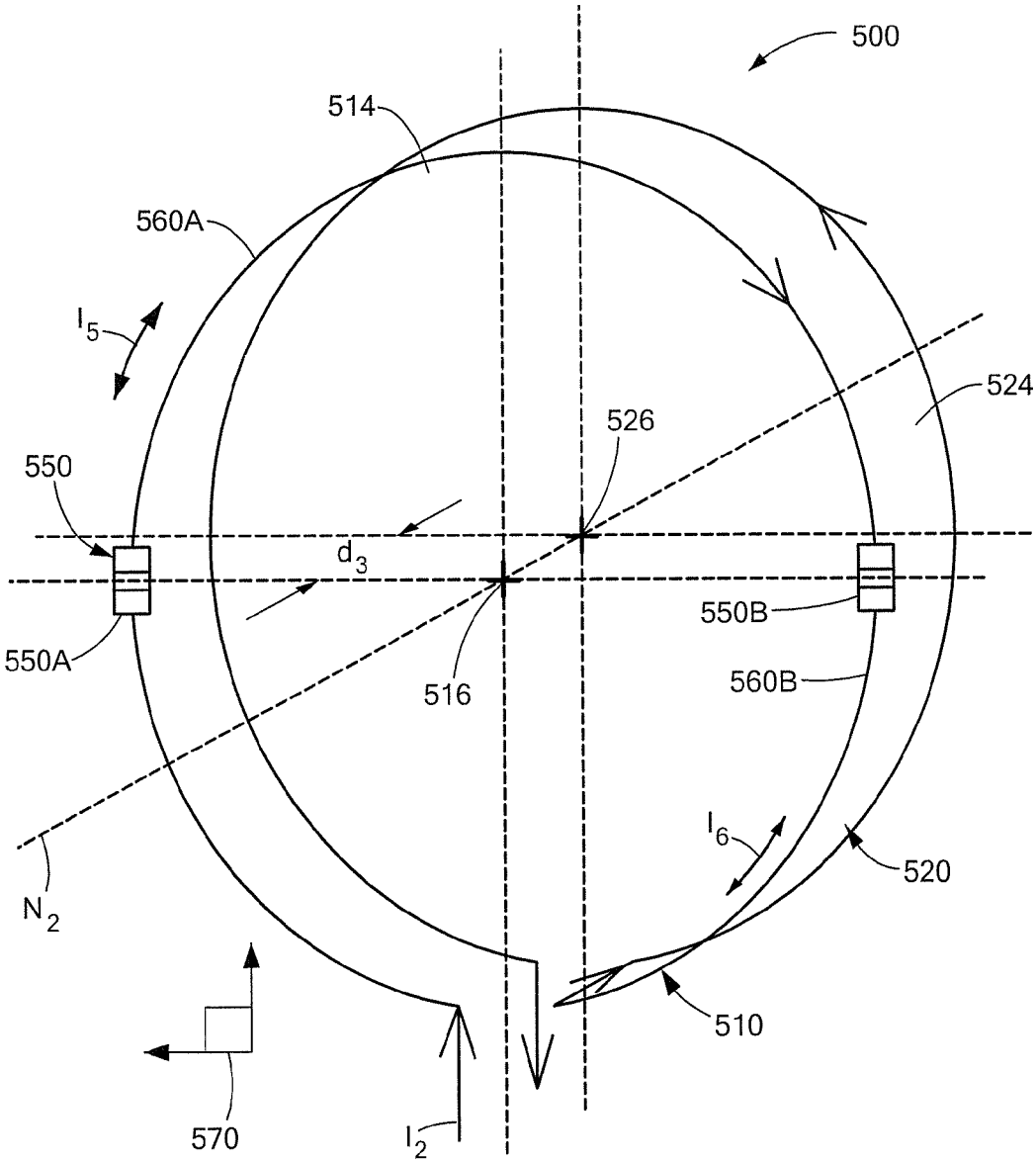
FIG. 5 is a pictorial view of another embodiment of an antenna according to the systems, concepts, and techniques described herein.

Referring now to FIG. 5, in another embodiment antenna 500 includes first loop 510 defining first enclosed area 514 and having first phase center point 516 defined by the geometric center point of first enclosed area 514. Antenna 500 also includes second loop 520 coupled to first loop 510, substantially parallel to first loop 510, and defining second enclosed area 524 and having second phase center point 526 defined by the geometric center point of second enclosed area 524. First adjuster element (an example of which is designated by reference numeral 550) is coupled to adjustable loop which is the same as one of first loop 510 or second loop 520 (in FIG. 5, adjustable loop is the same as first loop 510) and operable to expand or contract enclosed area 514 of adjustable loop 510. Line $N_2$ normal to plane 570 of first loop 510 passes through first and second phase center points 516, 526, and current $I_2$ supplied to antenna 500 is of opposite polarity in the respective first and second loops 510, 520.

In a further embodiment, second phase center point 526 of second loop 520 is defined a distance $d_3$ from first center point 516 of first loop 510 and current $I_2$ supplied to antenna 500 is of equal magnitude in respective first and second loops 510, 520. First adjuster element 550A is configured to adjust a size of the first enclosed area 514 of first loop 510 to minimize a difference between the size of first enclosed area 514 of first loop 510 and a size of second enclosed area 524 of second loop 520.

In still a further embodiment, first adjuster element 550A is operable to expand or contract length $l_5$ of first side 560A of adjustable loop 510 and antenna 500 includes second adjuster element 550B operable to expand or contract length $l_6$ of second side 560B of adjustable loop 510 opposing first side 560A of adjustable loop 510.

In a further embodiment, first adjuster element 550A is a screw assembly (as may be the same or similar to first screw assembly 252 described in conjunction with FIG. 2B) operable to expand or contract length $l_5$ of first side 560A of adjustable loop 510.

In another embodiment, first adjuster element 550A is a bevel gear assembly (as may be the same or similar to first gear assembly 352 described in conjunction with FIG. 3B) operable to expand or contract length $l_5$ of first side 560A of adjustable loop 510.

Figure 6A:
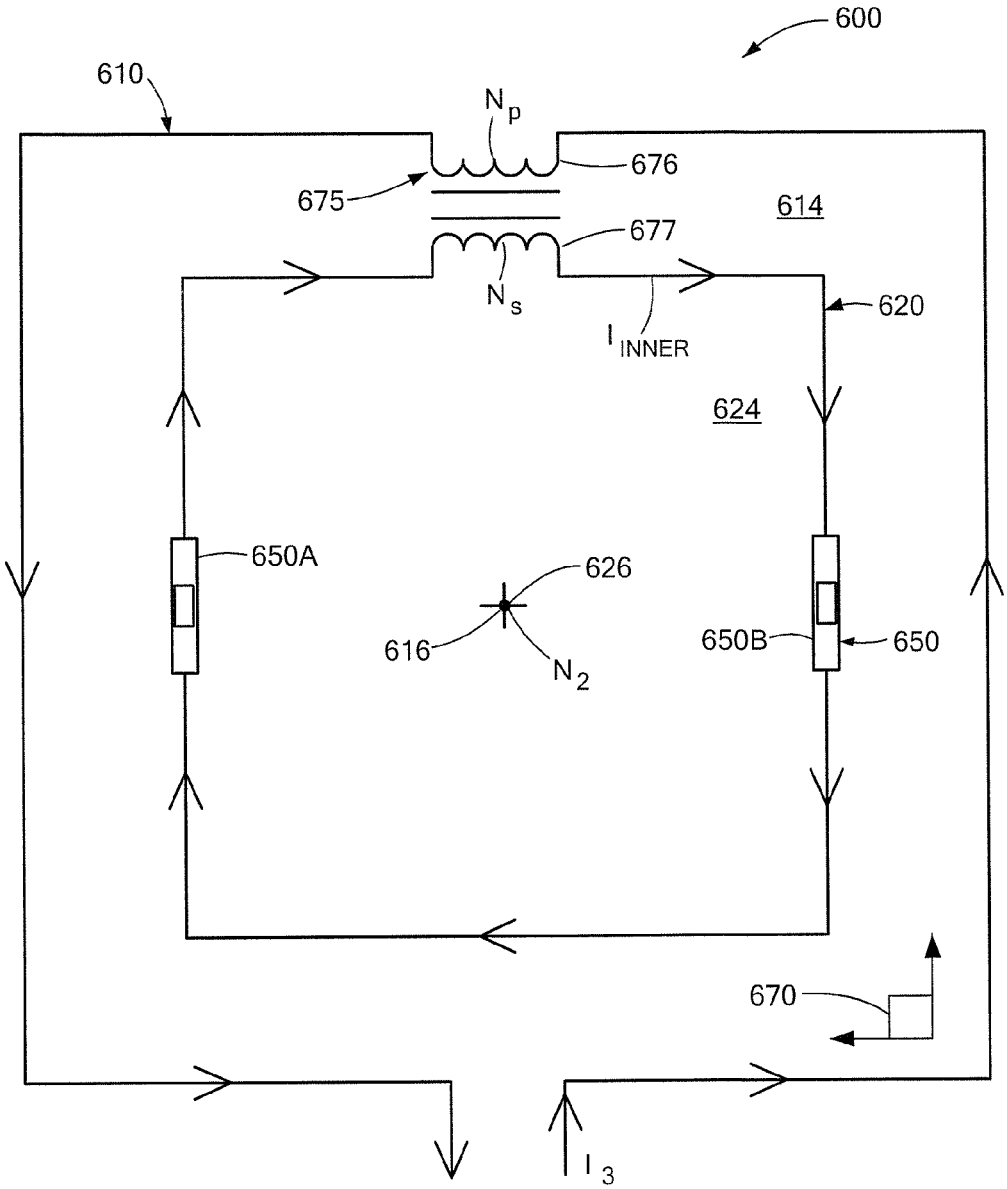
FIG. 6A is a pictorial view of a more detailed embodiment of the antenna of FIG. 5 including a transformer.

Referring now to FIG. 6A, in a further embodiment antenna 600 includes first loop 610 defining first enclosed area 614 and having first phase center point 616 defined by the geometric center point of first enclosed area 614. Antenna 600 also includes second loop 620 coupled to first loop 610, substantially parallel to first loop 610, and defining second enclosed area 624 and having second phase center point 626 defined by the geometric center point of second enclosed area 624. First adjuster element (an example of which is designated by reference numeral 650) is coupled to an adjustable loop including at least one of first loop 610 or second loop 520 (in FIG. 6A, adjustable loop is second loop 620) and operable to expand or contract enclosed area 614 of adjustable loop 610. Line $N_2$ normal to plane 670 of first loop 610 passes through first and second phase center points 616, 626, and current $I_3$ supplied to antenna 600 is of opposite polarity in the respective first and second loops 610, 620.

In another embodiment, second enclosed area 624 of second loop 620 (hereinafter referred to as the inner loop) is smaller than first enclosed area 614 of first loop 610 (hereinafter referred to as the outer loop). First transformer 675 couples outer loop 610 to inner loop 620 and controls current $I_{INNER}$ supplied to inner loop 620, wherein current $I_{INNER}$ supplied to inner loop 620 corresponds to a coil turn ratio of first transformer 675 equal to the number of turns $N_P$ of primary coil 676 of first transformer 675 over the number of turns of $N_S$ secondary coil 677 of first transformer 675.

Current supplied to outer loop 610 may be referred to as $I_{OUTER}$, enclosed area 614 of outer loop 610 may be referred to as $A_{OUTER}$, and enclosed area 624 of inner loop 620 may be referred to as $A_{INNER}$. Current area product of outer loop and current area product of inner loop may be defined, respectively, as $I_{OUTER}*A_{OUTER}$ and $I_{INNER}*A_{INNER}$.

Current area products of inner and outer loops 610, 620 may be equalized by adjusting $I_{INNER}$ to be a multiple X of $I_{OUTER}$, according to the following equation:

$$I_{INNER}=X*I_{OUTER}.$$

In some embodiments, multiple X equals a coil turn ratio TR of first transformer 675, which may be defined according to the following equation:

$$TR=N_P/N_S$$

In the same or different embodiment, TR is inversely proportional to a ratio of $A_{OUTER}$ over $A_{INNER}$. Here, TR may be determined using the following equation.

$$TR=1/(A_{INNER}/A_{OUTER}).$$

For example, if $A_{OUTER}$=2 square-feet, and $A_{INNER}$=1 square-foot, than TR will equal 2. In other words, $N_P=2*N_S$, or 2:1.

In a further embodiment, antenna 600 includes first adjuster element 650A and second adjuster element 650B operable to expand or contract inner loop enclosed area 624 symmetrically about inner loop phase center point 626. Inner loop enclosed area 624 may be adjusted to compensate for any deviation in a selected coil turn ratio for first transformer 675. Advantageously, antenna 600 can minimize and/or substantially eliminate far-field radiation with a relatively simple topography. Coil turn ratio for first transformer 675 may be increased for improved near-field radiation performance of antenna 600. This may result in a reduction of inter-turn capacity of first transformer 675 which may lead to an increased self-resonant frequency of antenna 600 and improved current balance between antenna loops 610, 620.

Figure 6B:
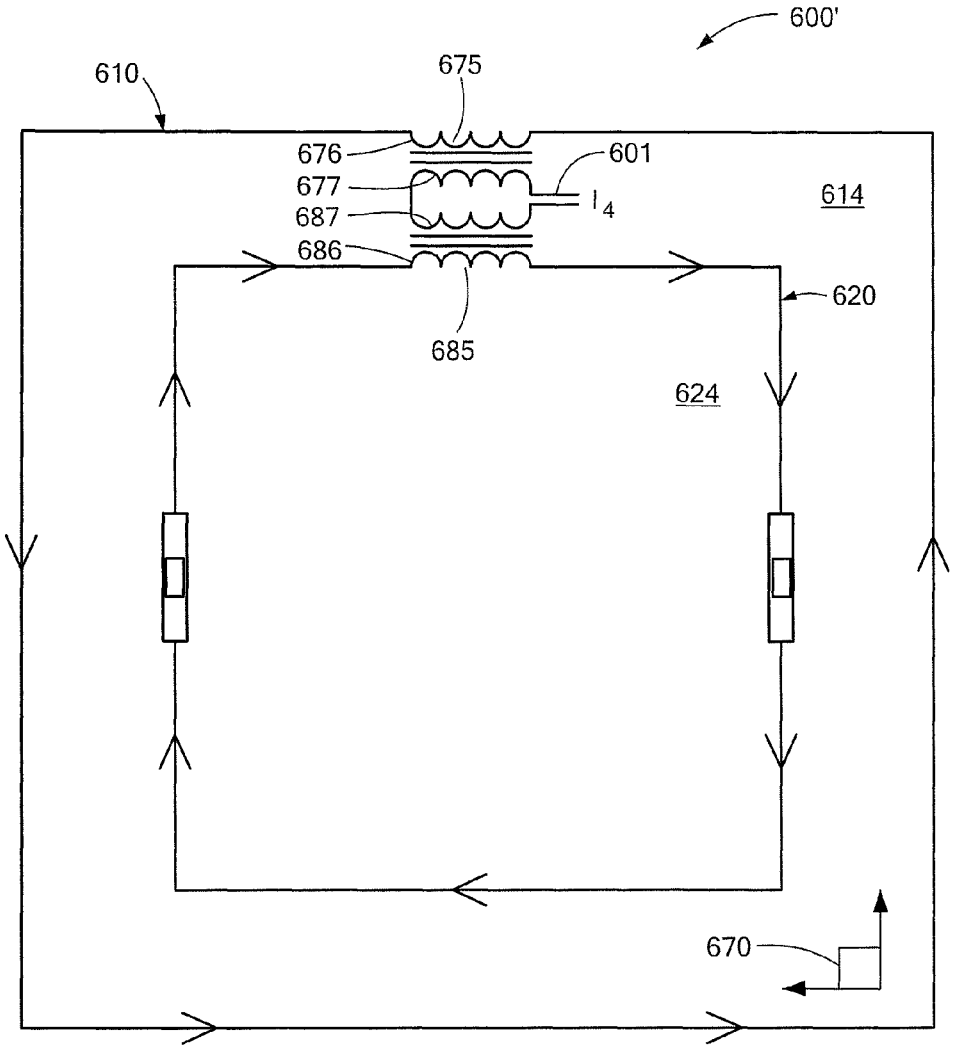
FIG. 6B is a pictorial view of a more detailed embodiment of the antenna of FIG. 5 including a first transformer and a second transformer.

Referring now to FIG. 6B, in which like elements of FIG. 6A are shown with like reference designations, in a further embodiment antenna 600' includes second transformer 685 connected to first transformer 675 and to one of outer loop 610 or second loop 620. Current $I_4$ is feed to antenna 600' via feed 601. Here, second transformer 685 has a coil turn ratio equal to the coil turn ratio of first transformer 675. If the number of turns of primary coils 676, 686 of respective first and second transformers 675, 685 equals $N_P$, and the number of turns of secondary coils of 677,687 of respective first and second transformer 675, 685 equals $N_S$, then current flow $I_{INNER}$ in inner loop 620 can be defined according to the following equation:

$I_{INNER}=N_S*(I_4/N_P)$.

Current flow $I_{OUTER}$ in outer loop 610 can be defined according to the following equation:

$I_{OUTER}=N_P*(I_4/N_S)$.

Advantageously, antenna 600' can minimize any potential phase and amplitude deviations in feed current $I_4$ introduced by first and second transformers 675, 685. Here, because first and second transformers 675, 685 are substantially identical (i.e., because first and second transformers 675, 685 have equal coil turn ratios) unwanted contributions (i.e., undesirable deviations) from first and second transformers 675, 685 tend to cancel each other out.

In some embodiments, a product of the coil turn ratio of first transformer 675 and a coil turn ratio of second transformer 685 is equal to a ratio between a size of first enclosed area 614 of first loop 610 and a size of second enclosed area 624 of the second loop 620.

Figure 7:
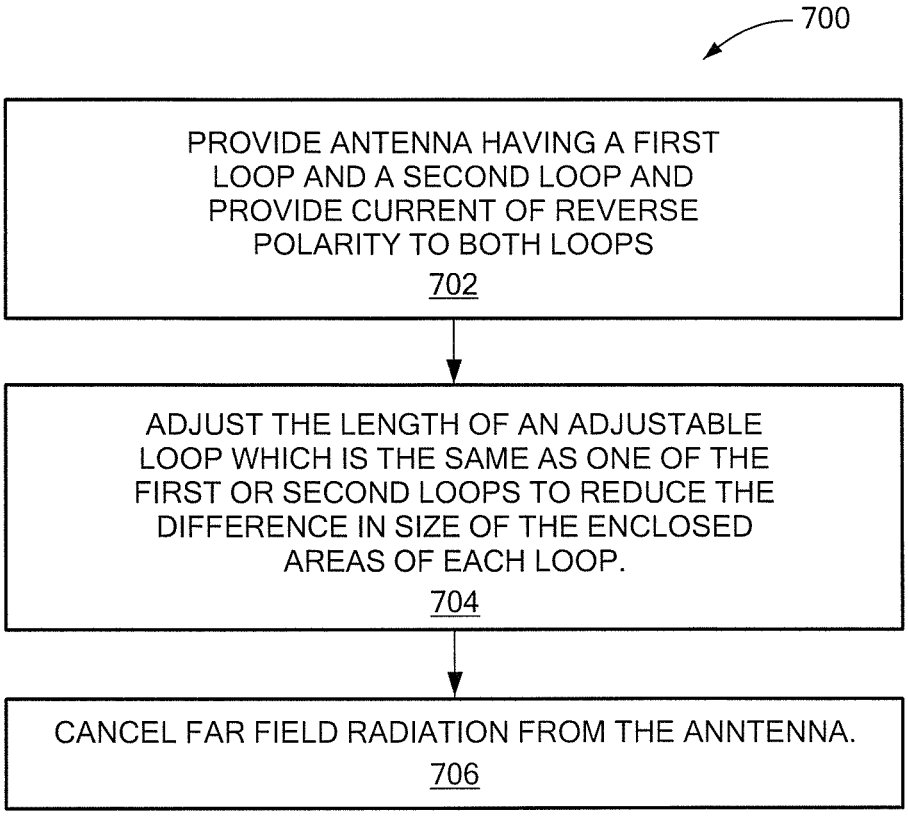
FIG. 7 is a flow diagram of a method according to the systems, concepts, and techniques described herein.

Referring now to FIG. 7, a method 700 for controlling far field radiation from an antenna having a first loop defining a first enclosed area and a second loop defining a second enclosed area includes, at 702, providing current of reverse polarity to both loops and, at 704, adjusting the length of an adjustable loop which is the same as one of the first or second loops to reduce the difference in size of the first enclosed area and the second enclosed area, and, at 706, reduce, minimize, and/or substantially cancel far field radiation from the antenna.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. An antenna comprising:

a first loop defining a first enclosed area and having a first phase center point defined by the geometric center point of the first enclosed area;

a second loop coupled to the first loop and disposed substantially parallel to the first loop, the second loop defining a second enclosed area and a second phase center point defined by the geometric center point of the second enclosed area; and a third loop coupled to the first loop and the second loop and substantially parallel to the first loop, the third loop defining a third enclosed area and a third phase center point defined by the geometric center point of the third enclosed area; and a plurality of adjuster elements coupled to at least one of the first loop, the second loop, or the third loop to provide an adjustable loop and configured to expand or contract the enclosed area of the adjustable loop, wherein a line normal to the plane of the first loop passes through the first phase center point of the first loop, the second phase center point of the second loop, and the third phase center point of the third loop, and a current supplied to the antenna flows in a first polarity in the third loop and flows in a second polarity in the first loop and the second loop, the first and second polarities being opposite to each other wherein the plurality of adjuster elements comprises:

a first bevel gear assembly rotatably coupled to the adjustable loop and operable to expand or contract a length of a first side of the adjustable loop;

a second bevel gear assembly rotatably coupled to the adjustable loop and operable to expand or contract a length of a second side of the adjustable loop, first and second sides being opposed to each other; and a third bevel gear assembly rotatably coupled to the first bevel gear assembly and the second bevel gear assembly and operable to expand or contract the length of the first side of the adjustable loop and the length of the second side of the adjustable loop.

2. The antenna of claim 1, further comprising a support frame coupled to at least one of the first adjuster element or the second adjuster element.

3. The antenna of claim 1, wherein the plurality of adjuster elements includes a first adjuster element and a second adjuster element, the first and second adjuster elements configured to expand or contract the enclosed area of the adjustable loop symmetrically about the phase center point of the adjustable loop.

4. The antenna of claim 1, wherein the first enclosed area of the first loop and the second enclosed area of the second loop are substantially equal in size, the adjustable loop is the third loop disposed about the first and second loops, and the plurality of adjuster elements is configured to adjust the size of the third enclosed area to minimize a difference between a size of the third enclosed area and a sum of a size of the first enclosed area and a size of the second enclosed area.

5. An antenna comprising:

a first loop defining a first enclosed area and having a first phase center point defined by the geometric center point of the first enclosed area;

a second loop coupled to the first loop and substantially parallel to the first loop, the second loop defining a second enclosed area and having a second phase center point defined by the geometric center point of the second enclosed area; and a first adjuster element coupled to an adjustable loop, which is the same as one of the first loop or the second loop, the first adjuster element configured to expand or contract the enclosed area of the adjustable loop, wherein a line normal to the plane of the first loop passes through the first and second phase center points, and a current supplied to the antenna is of opposite polarity in the first and second loops wherein the first adjuster element includes a plurality of adjuster elements comprising:

a first bevel gear assembly rotatably coupled to the adjustable loop and operable to expand or contract a length of a first side of the adjustable loop;

a second bevel gear assembly rotatably coupled to the adjustable loop and operable to expand or contract a length of a second side of the adjustable loop; and a third bevel gear assembly coupled to the first bevel gear assembly and to the second bevel gear assembly and operable to expand or contract the length of the first side of the adjustable loop and the length of the second side of the adjustable loop.

6. The antenna of claim 5, wherein the adjustable loop is the first loop, the second phase center point of the second loop is defined a distance from the first phase center point of the first loop, the first adjuster element is configured to adjust a size of the first enclosed area to minimize a difference between the size of the first enclosed area of the first loop and a size of the second enclosed area.

7. The antenna of claim 6, further comprising a support frame coupled to at least one of the first adjuster element or the second adjuster element.

8. The antenna of claim 5, wherein the second enclosed area is smaller than the first enclosed area, further comprising:

a first transformer to couple the first loop to the second loop and to control the current supplied to the second loop, wherein the current supplied to the second loop corresponds to a coil turn ratio of the first transformer equal to the number of turns of the primary coil of the first transformer over the number of turns of the secondary coil of the first transformer.

9. The antenna of claim 8, wherein the coil turn ratio of the first transformer corresponds to a ratio of a size of the first enclosed area over a size of the second enclosed area.

10. The antenna of claim 8, further comprising:

a second transformer connected to the first transformer and to one of the first loop or the second loop.

11. The antenna of claim 10, wherein a product of the coil turn ratio of the first transformer and a coil turn ratio of the second transformer is equal to a ratio between a size of the first enclosed area of the first loop and a size of the second enclosed area of the second loop.

12. A method for controlling far field radiation from an antenna having a first loop, second loop, and third loop, comprising:

providing current of a first polarity to the first loop and the second loop and of a second polarity to the third loop, the first and second polarities being opposite to each other, adjusting an area of an adjustable loop which is the same as one of the first loop, the second loop, or the third loop to reduce a difference in a total size of a first enclosed area defined by the first loop and a second enclosed defined by the second loop and a size of a third enclosed area defined by the third loop such that the far field radiation from the first loop and the second loop is of opposite phase and equal strength to the far field radiation from the third loop to cancel far field radiation from the antenna wherein adjusting the area of the adjustable loop comprises:

providing a first bevel gear assembly coupled to the adjustable loop operating to expand or contract a length of a first side of the adjustable loop;

providing a second bevel gear assembly coupled to the adjustable loop operating to expand or contract a length of a second side of the adjustable loop; and rotating a third bevel gear assembly coupled to the first bevel gear assembly and to the second bevel gear assembly and operating to expand or contract the length of the first side of the adjustable loop and the length of the second side of the adjustable loop.

13. The method of claim 12, wherein adjusting the area of the adjustable loop comprises:

adjusting a length of a first side of the adjustable loop and adjusting a length of a second side of the adjustable loop, the first and second sides being opposed to each other.

14. The method of claim 12, wherein the first loop, second loop, and third loop have coincident phase center points and adjusting an area of an adjustable loop comprises:

adjusting the size of the enclosed area of the adjustable loop about the phase center point of the adjustable loop.

15. The method of claim 12, wherein the adjustable loop is the first loop enclosed by the second loop and the third loop and adjusting the area of the first loop comprises:

adjusting the size of the first enclosed area to minimize a difference between the size of the third enclosed area and the total size of the first enclosed area and the second enclosed area.

16. The method of claim 12, wherein the adjustable loop is the second loop enclosed by the third loop and enclosing the first loop and adjusting the area of the second loop comprises:

adjusting the size of the second enclosed area to minimize a difference between the size of the third enclosed area and the total size of the first enclosed area and the second enclosed area.

17. The method of claim 12, wherein the adjustable loop is the third loop enclosing the first loop and the second loop and adjusting the area of the third loop comprises:

adjusting the size of the third enclosed area to minimize a difference between the size of the third enclosed area and the total size of the first enclosed area and the second enclosed area.

18. A method for controlling far field radiation from an antenna having a first loop defining a first enclosed area and a second loop defining a second enclosed area, comprising:

providing current of reverse polarity to both loops; and adjusting the length of an adjustable loop which is the same as one of the first or second loops to reduce a difference in a size of the first enclosed area and a size of the second enclosed area such that the far field radiation from the first loop and the second loop is of opposite phase and relatively equal strength to cancel far field radiation from the antenna wherein adjusting the length of the adjustable loop comprises:

providing a first bevel gear assembly coupled to the adjustable loop operating to expand or contract a length of a first side of the adjustable loop;

providing a second bevel gear assembly coupled to the adjustable loop operating to expand or contract a length of a second side of the adjustable loop; and rotating a third bevel gear assembly coupled to the first bevel gear assembly and to the second bevel gear assembly and operating to expand or contract the length of the first side of the adjustable loop and the length of the second side of the adjustable loop.

19. The method of claim 18, wherein adjusting the length of the adjustable loop comprises:

adjusting a length of a first side of the adjustable loop and adjusting a length of a second side of the adjustable loop opposing the first side of the adjustable loop.

20. The method of claim 18, wherein the first loop has a first phase center point and the second loop has a second phase center point coincident with the first phase center point and adjusting the length of the adjustable loop comprises:

adjusting the size of the enclosed area of the adjustable loop about the phase center point of the adjustable loop.

21. The method of claim 18, further comprising:

coupling the first and second loops using a transformer, and providing a current to one of the primary coil or the secondary coil of the transformer to equalize a current area product of the first loop and a current area product of the second loop to cancel far field radiation from the antenna.

* * * * *